United States Patent [19]

Vanier

[11] Patent Number: 4,892,860

[45] Date of Patent: Jan. 9, 1990

[54] SLIPPING LAYER CONTAINING AMINO-MODIFIED SILOXANE AND ORGANIC LUBRICATING PARTICLES FOR DYE-DONOR ELEMENT USED IN THERMAL DYE TRANSFER

[75] Inventor: Noel R. Vanier, Rochester, N.Y.

[73] Assignee: Eastman Kodak Company, Rochester, N.Y.

[21] Appl. No.: 273,380

[22] Filed: Nov. 18, 1988

Related U.S. Application Data

[63] Continuation-in-part of Ser. No. 173,345, Mar. 25, 1988, abandoned.

[51] Int. Cl.[4] ..... B41M 5/35; B41M 5/26

[52] U.S. Cl. ..... 503/227; 8/471; 428/195; 428/323; 428/327; 428/342; 428/422; 428/447; 428/913; 428/914

[58] Field of Search ..... 8/471; 428/195, 323, 428/327, 341, 342, 421, 422, 447, 913, 914; 503/227

[56] References Cited

FOREIGN PATENT DOCUMENTS 0138483 4/1985 European Pat. Off. ..... 503/227
0163145 12/1985 European Pat. Off. ..... 503/227

*Primary Examiner*—Bruce H. Hess
*Attorney, Agent, or Firm*—Harold E. Cole

[57] ABSTRACT

A dye-donor element for thermal dye transfer comprising a support having on one side thereof a dye layer and on the other side a slipping layer comprising a lubricating material in a polymeric binder, the lubricating material comprising a linear or branched aminoalkyl-terminated poly(dialkyl, diaryl or alkylaryl siloxane) such as an aminopropyldimethyl-terminated polydimethylsiloxane or a T-structure polydimethylsiloxane with an aminoalkyl functionality at the branchpoint, and organic lubricating particles such as micronized polyethylene particles or micronized polytetrafluoroethylene powder.

20 Claims, No Drawings

SLIPPING LAYER CONTAINING AMINO-MODIFIED SILOXANE AND ORGANIC LUBRICATING PARTICLES FOR DYE-DONOR ELEMENT USED IN THERMAL DYE TRANSFER

This application is a continuation-in-part of U.S. application Ser. No. 173,345, filed Mar. 25, 1988, now abandoned.

This invention relates to dye-donor elements used in thermal dye transfer, and more particularly to the use of a certain slipping layer, comprising organic lubricating particles and a lubricating material in a polymeric binder, on the back side thereof to prevent various printing defects and tearing of the donor element during the printing operation. The lubricating material comprises a linear or branched aminoalkyl-terminated poly(dialkyl, diaryl or alkylaryl siloxane).

In recent years, thermal transfer systems have been developed to obtain prints from pictures which have been generated electronically from a color video camera. According to one way of obtaining such prints, an electronic picture is first subject to color separation by color filters. The respective color-separated images are then converted into electrical signals. These signals are then operated on to produce cyan, magenta and yellow electrical signals. These signals are then transmitted to a thermal printer. To obtain the print, a cyan, magenta or yellow dye-donor element is placed face-to-face with a dye-receiving element. The two are then inserted between a thermal printing head and a platen roller. A line-type thermal printing head is used to apply heat from the back of the dye-donor sheet. The thermal printing head has many heating elements and is heated up sequentially in response to the cyan, magenta and yellow signals. The process is then repeated for the other two colors. A color hard copy is thus obtained which corresponds to the original picture viewed on a screen. Further details of this process and an apparatus for carrying it out are contained in U.S. Pat. No. 4,621,271 by Brownstein entitled "Apparatus and Method For Controlling A Thermal Printer Apparatus," issued Nov. 4, 1986, the disclosure of which is hereby incorporated by reference.

A problem has existed with the use of dye-donor elements for thermal dye-transfer printing because a thin support is required in order to provide effective heat transfer. For example, when a thin polyester film is employed, it softens when heated during the printing operation and then sticks to the thermal printing heat. This causes intermittent rather than continuous transport across the thermal head. The dye transferred thus does not appear as a uniform area, but rather as a series of alternating light and dark bands (chatter marks). Another defect called "smiles", which are crescent shaped low density areas, is produced in the receiving element by stretch-induced folds in the dye-donor. Another defect is produced in the receiving element when abraded or melted debris from the back of the dye-donor builds up on the thermal head and causes steaks parallel to the travel direction and extending over the entire image area. In extreme cases, sufficient friction is often created to tear the dye-donor element during printing. It would be desirable to eliminate such problems in order to have a commercially acceptable system.

U.S. application Ser. No. 062,796 of Vanier and Evans, filed June 16, 1987, now U.S. Pat. No. 4,738,950, relates to the use of particular amino-modified silicone materials for use as a slipping layer in thermal dye transfer systems. There is a problem with these materials, however, when the dye-donor element is wound up on itself during storage. During such storage, the dye layer side is in contact with the slipping layer and some unwanted dye transfer takes place from the dye layer to the slipping layer. This problem is particularly acute with the cyan dye and is promoted by lubricant from the slipping layer transferring to the dye layer. Extensive unwanted transfer of dye to the slipping layer results in lower transferred dye to the receiving layer and often is indicative of potential dye crystallization problems in the dye-donor itself. In addition, printing defects are occasionally obtained with this slipping layer material under severe thermal printing conditions, such as increasing the power or duration of power supplied for each printing dot. It would be desirable to eliminate or lessen these problems.

European Patent Application No. 163,145 relates to dye-donor elements having a slipping layer on the back side thereof comprising a liquid lubricant in a resin binder along with fine particles. A large list of lubricating materials is disclosed including various modified silicone oils such as an amino-modified silicone oil. No specific examples are disclosed, however. In addition, the particles disclosed in the examples for use in the slipping layer are inorganic particles such as silicon dioxide, not organic lubricating particles as described herein. As will be shown by comparative tests hereinafter, fewer or less severe printing defects are obtained using organic lubricating particles rather than inorganic lubricants.

Accordingly, this invention relates to a dye-donor element for thermal dye transfer comprising a support having on one side thereof a dye layer and on the other side a slipping layer comprising a lubricating material in a polymeric binder, the lubricating material comprising a linear or branched aminoalkyl-terminated poly(dialkyl, diaryl or alkylaryl siloxane), and wherein the slipping layer also comprises organic lubricating particles.

Many different lubricating particles may be used in the invention as long as they are organic and have the desired property of being lubricious in nature. Such materials would include particles having long hydrocarbon chains (greater than 8), polyolefins, long-chain amides, acids, alcohols, amines, phosphates, etc.; polyfluorocarbons, polyalkyl(aryl)siloxanes, etc. For example, there may be employed the following materials:

ORGANIC LUBRICATING PARTICLES (1) micronized polyethylene particles, such as MPP-620XF® from Micro Powders Inc., average particle size 2 μm and melting point of 116° C.;

(2) micronized polytetrafluoroethylene fluorocarbon powder, such as Fluo HT® from Micro Powders Inc. having a particle size of 2–4 μm;

(3) Polyfluo 190® (Micro Powders Inc.) combination of polytetrafluoroethylene and polyethylene wax having an average particle size of 3 μm;

(4) Whitcon TL 120® (LNP Engineering Plastics) fluorinated ethylene propylene having an average particle size of 1–2 μm;

(5) S-400 N1® (Shamrock Technologies, Inc.) synthetic ethylene bis-stearamide wax having an average particle size of 5 μm;

(6) S-363 N1® (Shamrock Technologies, Inc.) described as being an "alloy" of polypropylene and a modifying polymer having an average particle size of 5 μm;

(7) S-394 N1 ® (Shamrock Technologies, Inc.) micronized polyethylene wax having an average particle size of 12 μm, m.p. 125° C.;

(8) S-395 N1 ® (Shamrock Technologies, Inc.) micronized polyethylene wax having an average particle size of 5 μm, m.p. 125° C.; or (9) Tospearl 120 ® (Toshiba Silicon Co. Ltd.) poly(methylsilylsequioxane) resin powder having an average particle size of 2 μm.

The lubricating particles may be employed in and concentration which is effective for the intended purpose. In general, good results have been obtained at a construction of from about 0.005 g/m$^2$ to about 1.0 g/m$^2$.

Any polysiloxane can be employed in the slipping layer of the invention providing it contains units of a linear or branched aminoalkyl-terminated poly(dialkyl, diaryl or alkylaryl siloxane). In a preferred embodiment of the invention, the siloxane is an aminopropyldimethyl-terminated polydimethylsiloxane such as one having the formula:

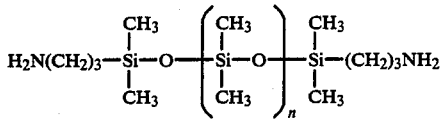

wherein n is from about 10 to about 2000. This material is supplied commercially from Petrarch Systems, Inc. Bartram Rd. Bristol, Pa. 19007 as PS513 ®.

In another preferred embodiment of the invention, the siloxane polymer is a T-structure polydimethylsiloxane with an aminoalkyl functionality at the branchpoint, such as one having the formula

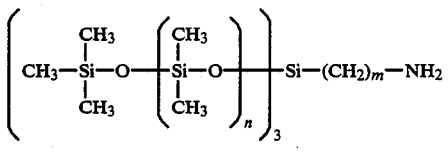

wherein m is from about 1 to about 100 and n is from about 10 to about 1000. This material is supplied commercially from Petrarch Systems, Inc. as PS054 ®.

The polysiloxane may be present in any amount which is effective for the invented purpose. In a preferred embodiment of the invention, the polysiloxane is present in an amount of from about 0.0005 to about 0.05 g/m$^2$, representing approximately 0.1 to 10% of the binder weight.

Any polymeric binder can be used in the slipping layer of the invention provided it has the desired effect. In a preferred embodiment, thermoplastic binders are employed. Examples of such materials include, for example, poly(styrene-co-acrylonitrile) (70/30 wt. ratio); poly(vinyl alcohol-co-butyral) (available commercially as Butvar 76 ® by Dow Chemical Co.; poly(vinyl alcohol-co-acetal); poly(vinyl alcohol-co-benzal); polystyrene; poly(vinyl acetate); cellulose acetate butyrate; cellulose acetate propionate; cellulose acetate; ethyl cellulose; bisphenol-A polycarbonate resins; cellulose triacetate; poly(methylmethacrylate); copolymers of methyl methacrylate; poly(styrene-co-butadiene); and a lightly branched ether modified poly(cyclohexylene-cyclohexanedicarboxylate):

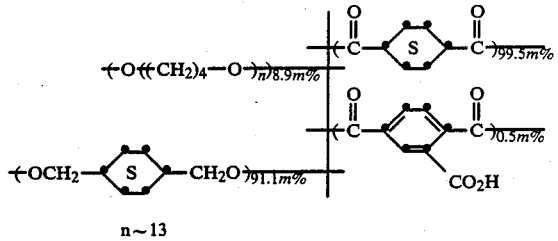

In a preferred embodiment of the invention, the thermoplastic binder is cellulose acetate propionate.

The amount of polymeric binder used in the slipping layer of the invention is not critical. In general the polymeric binder may be present in an amount of from about 0.1 to about 2 g/m$^2$.

Any dye can be used in the dye layer of the dye-donor element of the invention provided it is transferable to the dye-receiving layer by the action of heat. Especially good results have been obtained with sublimable dyes. Examples of sublimable dyes include anthraquinone dyes, e.g., Sumikalon Violet RS ® (product of Sumitomo Chemical Co., Ltd.), Dianix Fast Violet 3R-FS ® (product of Mitsubishi Chemical industries, Ltd.), and Kayalon Polyol Brilliant Blue N-BGM ® and KST Black 146 ® (products of Nippon Kayaku Co., Ltd.); azo dyes such as Kayalon Polyol Brilliant Blue BM ®, Kayalon Polyol Dark Blue 2BM ®, and KST Black KR ® (products of Nippon Kayaku Co., Ltd.), Sumickaron Diazo Black 5G ® (product of Sumitomo Chemical Co., Ltd.), and Miktazol Black 5GH ® (product of Mitsui Toatsu Chemicals, Inc.); direct dyes such as Direct Dark Green B ® (product of Mitsubishi Chemical Industries, Ltd.) and Direct Brown M ® and Direct Fast Black D ® (products of Nippon Kayaku Co. Ltd.); acid dyes such as Kayanol Milling Cyanine 5R ® (product of Nippon Kayaku Co. Ltd.); basic dyes such as Sumicacryl Blue 6G ® (product of Sumitomo Chemical Co., Ltd.), and Aizen Malachite Green ® (product of Hodogaya Chemical Co., Ltd.);

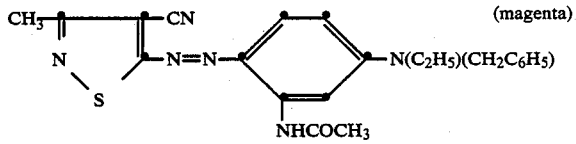

(magenta)

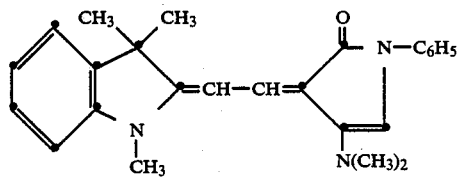

(yellow)

-continued

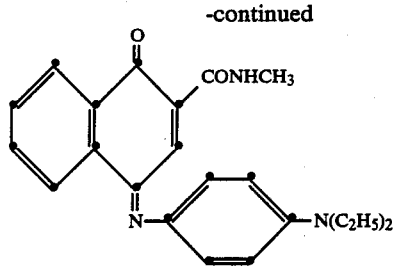

(cyan)

or any of the dyes disclosed in U.S. Pat. No. 4,541,830, the disclosure of which is hereby incorporated by reference. The above dyes may be employed singly or in combination to obtain a monochrome. The dyes may be used at a coverage of from about 0.05 to about 1 g/m$^2$ and are preferably hydrophobic.

A dye-barrier layer may be employed in the dye-donor elements of the invention to improve the density of the transferred dye. Such dye-barrier layer materials include hydrophilic materials such as those described and claimed in U.S. Pat. No. 4,716,144 by Vanier, Lum and Bowman.

The dye in the dye-donor element of the invention is dispersed in a polymeric binder such as a cellulose derivative, e.g., cellulose acetate hydrogen phthalate, cellulose acetate, cellulose acetate propionate, cellulose acetate butyrate, cellulose triacetate or any of the materials described in U.S. Pat. No. 4,700,207 of Vanier and Lum; a polycarbonate; poly(styrene-co-acrylonitrile), a poly(sulfone) or a poly(phenylene oxide). The binder may be used at a coverage of from about 0.1 to about 5 g/m$^2$.

The dye layer of the dye-donor element may be coated on the support or printed thereon by a printing technique such as a gravure process.

Any material can be used as the support for the dye-donor element of the invention provided it is dimensionally stable and can withstand the heat of the thermal printing heads. Such materials include polyesters such as poly(ethylene terephthalate); polyamides; polycarbonates; glassine paper; condenser paper; cellulose esters such as cellulose acetate; fluorine polymers such as polyvinylidene fluoride or poly(tetrafluoroethylene-co-hexafluoropropylene); polyethers such as polyoxymethylene; polyacetals; polyolefins such as polystyrene, polyethylene, polypropylene or methylpentane polymers; and polyimides such as polyimide-amides and polyetherimides. The support generally has a thickness of from about 2 to about 30 μm. It may also be coated with a subbing layer, if desired, such as those materials described in U.S. Pat. No. 4,695,288 of Ducharme or U.S. application Ser. No. 079,613 of Henzel, filed July 30, 1987.

The dye-receiving element that is used with the dye-donor element of the invention usually comprises a support having thereon a dye image-receiving layer. The support may be a transparent film such as a poly(ether sulfone), a polyimide, a cellulose ester such as cellulose acetate, a poly(vinyl alcohol-co-acetal) or a poly(ethylene terephthalate). The support for the dye-receiving element may also be reflective such as baryta-coated paper, polyethylene-coated paper, white polyester (polyester with white pigment incorporated therein), an ivory paper, a condenser paper or a synthetic paper such as duPont Tyvek®.

The dye image-receiving layer may comprise, for example, a polycarbonate, a polyurethane, a polyester, polyvinyl chloride, poly(styrene-co-acrylonitrile), poly(caprolactone) or mixtures thereof. The dye image-receiving layer may be present in any amount which is effective for the intended purpose. In general, good results have been obtained at a concentration of from about 1 to about 5 g/m$^2$.

As noted above, the dye-donor elements of the invention are used to form a dye transfer image. Such a process comprises imagewise-heating a dye-donor element as described above and transferring a dye image to a dye-receiving element to form the dye transfer image.

The dye-donor element of the invention may be used in sheet form or in a continuous roll or ribbon. If a continuous roll or ribbon is employed, it may have only one dye or may have alternating areas of other different dyes, such as sublimable cyan and/or magenta and/or yellow and/or black or other dyes. Such dyes are disclosed in U.S. Pat. Nos. 4,541,830; 4,698,651 of Moore, Weaver and Lum; 4,695,287 of Evans and Lum; and 4,701,439 of Weaver, Moore and Lum; and U.S. application Ser. Nos. 059,442 of Byers and Chapman, filed June 8, 1987; 059,443 of Evans and Weber, filed June 8, 1977; 095,796 of Evans and Weber, filed Sept. 14, 1987; and 123,441 of Byers, Chapman and McManus, filed Nov. 20, 1987, the disclosures of which are hereby incorporated by reference. Thus, one-, two-, three- or four-color elements (or higher numbers also) are included within the scope of the invention.

In a preferred embodiment of the invention, the dye-donor element comprises a poly(ethylene terephthalate) support coated with sequential repeating areas of yellow, cyan and magenta dye, and the above process steps are sequentially performed for each color to obtain a three-color dye transfer image. Of course, when the process is only performed for a single color, then a monochrome dye transfer image is obtained.

Thermal printing heads which can be used to transfer dye from the dye-donor elements of the invention are available commercially. There can be employed, for example, a Fujitsu Thermal Head (FTP-040 MCS001), a TDK Thermal Head F415 HH7-1089 or a Rohm Thermal Head KE 2008-F3.

A thermal dye transfer assemblage of the invention comprises (a) a dye-donor element as described above, and (b) a dye-receiving element as described above, the dye-receiving element being in a superposed relationship with the dye-donor element so that the dye layer of the donor element is in contact with the dye image-receiving layer of the receiving element.

The above assemblage comprising these two elements may be preassembled as an integral unit when a monochrome image is to be obtained. This may be done by temporarily adhering the two elements together at their margins. After transfer, the dye-receiving element is then peeled apart to reveal the dye transfer image.

When a three-color image is to be obtained, the above assemblage is formed on three occasions during the time when heat is applied by the thermal printing head. After the first dye is transferred, the elements are peeled apart. A second dye-donor element (or another area of the donor element with a different dye area) is then brought in register with the dye-receiving element and the process repeated. The third color is obtained in the same manner.

The following examples are provided to illustrate the invention.

EXAMPLE 1 - UNWANTED DYE TRANSFER HEAT

A cyan dye-donor element was prepared by coating on a 6 μm poly(ethylene terephthalate) support:

(1) a subbing layer of a titanium alkoxide (duPont Tyzor TBT®) (0.12 g/m²) from a n-propyl acetate and n-butyl alcohol solvent mixture, and (2) a dye layer containing the cyan dye illustrated above (0.28 g/m²) and duPont DLX-6000 Teflon® micropowder (0.016 g/m²), in a cellulose acetate propionate (2.5% acetyl, 45% propionyl) binder (0.44 g/m²) coated from a toluene, methanol and cyclopentanone solvent mixture.

In a similar manner, repeating alternating areas of yellow and magenta dyes similar to those illustrated above were coated. For purposes of this test, only the cyan dye area is considered to be relevant.

On the back side of the dye-donor was coated:

(1) a subbing layer of a titanium alkoxide (duPont Tyzor TBT®) (0.12 g/m ²) from a n-propyl acetate and n-butyl alcohol solvent mixture, and (2) a slipping layer of Petrarch Systems PS513® amino-terminated polysiloxane identified above (0.008 g/m²), p-toluenesulfonic acid (2.5% of the wt. of the polysiloxane), and organic lubricating particles 1 and 2 identified above (0.054 g/m²) in a cellulose acetate propionate binder (2.5% acetyl, 45% propionyl) 0.27 g/m²) coated from a toluene and 3-pentanone solvent mixture.

The coated dye-donor was multi-wrapped about itself on a one-inch diameter wooden roller and incubated for three days at 60° C., 60% RH. After this period of time, the density of cyan dye transferred to the backing (slipping) layer was determined by reading the Status A red transmission density. This was conveniently done where the cyan dye area overlaid the back of a yellow dye area. The following results were obtained:

TABLE 1

| Organic Lubricating Particles | Status A Red Transferred Density |
|---|---|
| None (control) | 0.24 |
| #1 (Polyethylene) | 0.09 |
| #2 (Polytetrafluoroethylene) | 0.18 |

The above results indicate that much lower red density readings (less cyan dye transferred) occurred in dye-donors that had organic lubricating particles in the slipping layer. This shows that unwanted dye transfer from the dye layer to the back of the dye-donor when it is wound up on itself is minimized when lubricating particles are added to the slipping layer.

EXAMPLE 2 - PHYSICAL DEFECTS TEST

A multicolor dye-donor was prepared by gravure coating on a 6 μm poly(ethylene terephthalate) support:

(1) a subbing layer of a titanium alkoxide (duPont Tyzor TBT® ) (0.12 g/m²) from a n-propyl acetate and n-butyl alcohol solvent mixture, and (2) a dye layer containing the cyan dye illustrated above (0.28 g/m²) and duPont DLX-6000 Teflon® micropowder (0.016 g/m²), in a cellulose acetate propionate (2.5% acetyl, 45% propionyl) binder (0.44 g/m²) coated from a toluene, methanol and cyclopentanone solvent mixture.

In a similar manner, repeating alternating areas of the yellow dye illustrated above at (0.14 g/m²) and the magenta dye illustrated above at (0.15 g/m²) were coated.

On the back side of the dye-donor was coated a subbing layer and slipping layer as in Example 1, along with a control of Zeothix 177® (J. M. Huber Co.) precipitated silica (0.054 g/m²) having an average particle size of 1.5 μm.

A dye-receiving element was prepared by coating the following layers in the order recited on a titanium dioxide-pigmented polyethylene-overcoated paper stock which was subbed with a layer of poly(acrylonitrile-co-vinylidene chloride-co-acrylic acid) 14:79:7 wt. ratio) (0.08 g/m²) coated from 2-butanone:

(1) Dye-receiving layer of Makrolon 5705® (Bayer AG Corporation) polycarbonate resin (2.9 g/m²), Tone PCL-300® polycaprolactone (Union Carbide) (0.38 g/m²), and 1,4-didecoxy-2,6-dimethoxyphenol (0.38 g/m²) coated from methylene chloride; and (2) Overcoat layer of Tone PCL-300® polycaprolactone (Union Carbide) (0.11 g/m²), FC-431® surfactant (3M Corp.) (0.016 g/m²) and DC-510® Surfactant (Dow Corning) (0.016 g/m²) coated from methylene chloride.

The dye side of the dye-donor element strip approximately 10 cm×13 cm in area was placed in contact with the dye image-receiving layer of the dye-receiver element of the same area. The assemblage was clamped to a stepper-motor driven 60 mm diameter rubber roller and a TDK Thermal Head (No. L-231) (thermostatted at 26° C.) was pressed with a force of 8.0 pounds (3.6 kg) against the dye-donor element side of the assemblage pushing it against the rubber roller.

The imaging electronics were activated causing the donor/receiver assemblage to be drawn between the printing head and roller at 6.9 mm/sec. Coincidentally, the resistive elements in the thermal print head were pulsed for 29 ® sec/pulse at 128 ® sec intervals during the 33 msec/dot printing time. A stepped density image was generated by incrementally increasing the number of pulses/dot from 0 to 255. The voltage supplied to the print head was approximately 23.5 volts, resulting in an instantaneous peak power of 1.3 watts/dot and a maximum total energy of 9.6 mjoules/dot.

The dye-receiving element was separated from the dye-donor element and was examined for "smile" printing defects which are crescent-shaped low density areas produced in the receiver by stretch-induced folds in the dye-donor. The following results were obtained:

TABLE 2

| Organic Lubricating Particles | Smile Defects Observed |
|---|---|
| None (control) | Yes |
| Precipitated silica (control) | Yes |
| #1 (Polyethylene) | No |
| #2 (Polytetrafluoroethylene) | No |

The above results indicate that the addition of organic lubricating particles eliminates smile defects, while inorganic particles do not.

EXAMPLE 3 - FORCE MEASUREMENT TEST

The dye-donors and dye-receiver of Example 2 were used as described in Example 2. As each "area test pattern" of given density was being generated, the force required for the pulling device to draw the assemblage between the print head and roller was measured using a Himmelstein Corp. 3-08TL(16-1) Torquemeter® (10 inch-lb. range) and 6-205 Conditioning Module ®. Data were obtained at Steps 2 and 8, a moderate density and maximum density, as being most illustrative. The following results were obtained:

TABLE 3

| Organic Lubricating Particles | Relative Force (lbs) Step 2 | Step 8 |
|---|---|---|
| None (control) | 1.1 | 1.0 |
| Precipitated silica (control) | 2.1 | 2.8 |
| #1 (Polyethylene) | 1.0 | 1.1 |
| #2 (Polytetrafluoroethylene) | 1.0 | 1.3 |

The above results indicate that inorganic particles produce high friction (higher relative force values) as compared to the organic lubricating particles employed in the invention. While the control with no particles also gave low force values, it produced dye-transfer upon incubation as shown in Example 1.

EXAMPLE 4 - UNWANTED DYE TRANSFER TEST

A magenta dye-donor element was prepared by coating on a 6 μm poly(ethylene terephthalate) support:

(1) a subbing layer of a titanium alkoxide (duPont Tyzor TBT ® ) (0.12 g/m$^2$) from a n-propyl acetate and n-butyl alcohol solvent mixture, and (2) a dye layer containing the magenta dye illustrated above (0.15 g/m$^2$) and Fluo-HT ® (Micropowders Inc.) micronized polytetrafluoroethylene beads (0.05 g/m$^2$), in a cellulose acetate propionate (2.5% acetyl, 45% propionyl) binder (0.32 g/m$^2$) coated from a toluene, methanol and cyclopentanone solvent mixture.

In a similar manner, repeating alternating areas of the yellow and cyan dyes illustrated above were coated. For purposes of this test, only the magenta dye area is considered to be relevant.

On the back side of the dye-donor was coated:

(1) a subbing layer of a titanium alkoxide (duPont Tyzor TBT ®) (0.12 g/m$^2$) from a n-propyl acetate and n-butyl alcohol solvent mixture, and (2) a slipping layer of Petrarch Systems PS513 ® amino-terminated polysiloxane identified above (0.009 g/m$^2$), p-toluenesulfonic acid (2.5% of the wt. of the polysiloxane), and organic lubricating particles 3–9 identified above (0.05 g/m$^2$) in a cellulose acetate propionate binder (2.5% acetyl, 45% propionyl) (0.27 g/m$^2$) coated from a toluene and 3-pentanone solvent mixture.

Two control donor elements were also prepared similar to the above: one without any organic lubricating particles and one with Zeothix 177 ® (J. M. Huber Corp.) precipitated silica of 1.7 μm average particle size.

The coated dye-donor was multi-wrapped about itself on a one-inch diameter wooden roller and incubated for three days at 60° C., 60% RH. After this period of time, the density of magenta dye transferred to the backing (slipping) layer was determined by reading the Status A green transmission density. This was conveniently done where the magenta dye area overlaid the back of a yellow dye area. The following results were obtained:

TABLE 4

| Organic Lubricating Particles | Status A Green Transferred Density |
|---|---|
| None (control) | 0.19 |
| Silica (control) | 0.14 |
| #3 (Polyethylene wax + polytetrafluoroethylene) | 0.14 |
| #4 (Fluorinated ethylene propylene) | 0.16 |
| #5 (Ethylene bis-stearamide wax) | 0.17 |
| #6 (Polypropylene + modifying polymer) | 0.16 |
| #7 (Polyethylene wax 12 μm) | 0.15 |
| #8 (Polyethylene wax 5 μm) | 0.15 |
| #9 (Poly(methylsilylsequioxane) | 0.14 |

The above results indicate that much lower green density readings (less magenta dye transferred) occurred in dye donors that had any form of particulate matter in the slipping layer. As Examples 5 and 6 show, however, only those particles which are organic lubricating particles avoid abnormally high force for passage through the thermal head and image defects.

EXAMPLE 5 - PHYSICAL DEFECTS TEST

Dye-donor elements were prepared as in Example 4. A dye-receiving element was prepared as in Example 2.

Image defects were evaluated as in Example 2 by printing a high-density image onto the dye-receiver element. After the dye-receiving element was separated from the dye-donor element, it was examined for "smile" printing defects which are crescent-shaped low density areas produced in the receiver by stretch-induced folds in the dye-donor. The following results were obtained:

TABLE 5

| Organic Lubricating Particles | Smile Defects Observed |
|---|---|
| None (control) | * |
| Silica (control) | Yes |
| #3 (Polyethylene wax + polytetrafluoroethylene) | No |
| #4 (Fluorinated ethylene propylene) | No |
| #5 (Ethylene bis-stearamide wax) | No |
| #6 (Polypropylene + modifying polymer) | No |
| #7 (Polyethllene wax 12 μm) | No |
| #8 (Polyethylene wax 5 μm) | No |
| #9 (Poly(methylsilylsequioxane) | No |

*Donor stuck to head at start of printing

The above results indicate that the addition of organic lubricating particles eliminates smile defects, while inorganic particles do not.

EXAMPLE 6 - FORCE MEASUREMENT TEST

Dye-donors were prepared as in Example 4. However, only the cyan dye areas were used for evaluation.

A dye-receiver was prepared as in Example 2. It was tested with the donor as described in Example 3. As each "area test pattern" of given density was being generated, the force required for the pulling device to draw the assemblage between the print head and roller was measured using a Himmelstein Corp. 3-08TL(16-1) Torquemeter ® (10 inch-lb. range) and 6-205 Conditioning Module ®. Data were obtained at Steps 2 and 8, a moderate density and maximum density, as being most illustrative. The following results were obtained:

TABLE 6

| Organic Lubricating Particles | Relative Force (lbs) Step 2 | Step 8 |
|---|---|---|
| None (control) | 1.2 | 1.5 |
| Silica (control) | 2.9 | 3.0 |
| #3 (Polyethylene wax + polytetrafluoroethylene) | 0.9 | 1.0 |
| #4 (Fluorinated ethylene propylene) | 1.2 | 1.6 |
| #5 (Ethylene bis-stearamide wax) | 1.0 | 0.9 |
| #6 (Polypropylene + modifying polymer) | 1.0 | 1.0 |
| #7 (Polyethylene wax 12 μm) | 1.0 | 1.1 |
| #8 (Polyethylene wax 5 μm) | 0.9 | 1.0 |
| #9 (Poly(methylsilylsequioxane) | 1.4 | 1.3 |

The above results indicate that inorganic particles produce high friction (higher relative force values) as compared to the organic lubricating particles employed in the invention. While the control with no particles also gave moderate force values, it produced backside dye-transfer upon incubation and image defects as shown in Examples 4 and 5.

The invention has been described in detail with particular reference to preferred embodiments thereof, but it will be understood that variations and modifications can be effected within the spirit and scope of the invention.

What is claimed is:

1. In a dye-donor element for thermal dye transfer comprising a support having on one side thereof a dye layer and on the other side a slipping layer comprising a lubricating material in a polymeric binder, said lubricating material comprising a linear or branched aminoalkyl-terminated poly(dialkyl, diaryl or alkylaryl siloxane), the improvement wherein said slipping layer also comprises organic lubricating particles.

2. The element of claim 1 wherein said organic lubricating particles are micronized polyethylene.

3. The element of claim 1 wherein said organic lubricating particles are micronized polytetrafluoroethylene.

4. The element of claim 1 wherein said polysiloxane is present in an amount of from about 0.0005 to about 0.05 g/m$^2$, representing approximately 0.1 to 20% of the binder weight, and the polymeric binder is a thermoplastic binder.

5. The element of claim 4 wherein said thermoplastic binder is cellulose acetate propionate.

6. The element of claim 1 wherein said siloxane is an aminopropyldimethyl-terminated polydimethylsiloxane.

7. The element of claim 6 wherein said polysiloxane has the formula:

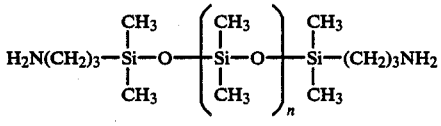

wherein n is from about 10 to about 2000.

8. The element of claim 1 wherein said siloxane polymer is a T-structure polydimethylsiloxane with an aminoalkyl functionality at the branchpoint.

9. The element of claim 8 wherein said siloxane polymer has the formula:

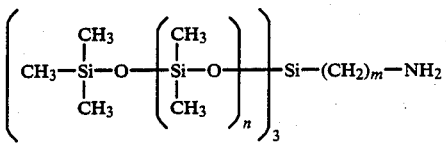

wherein m is from about 1 to about 10 and n is from about 10 to about 1000.

10. In a process of forming a dye transfer image comprising (a) imagewise-heating a dye-donor element comprising a support having on one side thereof a dye layer and on the other side a slipping layer comprising a lubricating material in a polymeric binder, said lubricating material comprising a linear or branched aminoalkyl-terminated poly(dialkyl, diaryl or alkylaryl siloxane), and (b) transferring a dye image to a dye-receiving element to form said dye transfer image, the improvement wherein said slipping layer also comprises organic lubricating particles.

11. The process of claim 10 wherein said organic lubricating particles are micronized polyethylene or polytetrafluoroethylene.

12. The process of claim 10 wherein said polysiloxane is present in an amount of from about 0.0005 to about 0.05 g/m$^2$, representing approximately 0.1 to 10% of the binder weight, and the polymeric binder is a thermoplastic binder.

13. The process of claim 10 wherein said siloxane is an aminopropyldimethyl-terminated polydimethylsiloxane or a T-structure polydimethylsiloxane with an aminoalkyl functionality at the branchpoint.

14. The process of claim 10 wherein said support is poly(ethylene terephthalate) which is coated with sequential repeating areas of cyan, magenta and yellow dye, and said process steps are sequentially performed for each color to obtain a three-color dye transfer image.

15. In a thermal dye transfer assemblage comprising:

(a) a dye-donor element comprising a support having on one side thereof a dye layer and on the other side a slipping layer comprising a lubricating material in a polymeric binder, said lubricating material comprising a linear or branched aminoalkylterminated poly(dialkyl, diaryl or alkylaryl siloxane), and (b) a dye-receiving element comprising a support having thereon a dye image-receiving layer, said dye-receiving element being in a superposed relationship with said dye-donor element so that said dye layer is in contact with said dye image-receiving layer, the improvement wherein said slipping layer also comprises organic lubricating particles.

16. The assemblage of claim 15 wherein said organic lubricating particles are micronized polyethylene.

17. The assemblage of claim 15 wherein said organic lubricating particles are micronized polytetrafluoroethylene.

18. The assemblage of claim 15 wherein said polysiloxane is present in an amount of from about 0.0005 to about 0.05 g/m$^2$, representing approximately 0.1 to 10% of the binder weight, and the polymeric binder is a thermoplastic binder.

19. The assemblage of claim 18 wherein said thermoplastic binder is cellulose acetate propionate.

20. The assemblage of claim 15 wherein said siloxane is an aminopropyldimethyl-terminated polydimethylsiloxane or a T-structure polydimethylsiloxane with an aminoalkyl functionality at the branchpoint.

* * * * *